US009651007B2

(12) United States Patent
Etherington-Smith

(10) Patent No.: US 9,651,007 B2
(45) Date of Patent: May 16, 2017

(54) MARINE PROPULSION UNIT AND A VALVE FOR A MARINE PROPULSION UNIT

(71) Applicant: E.P. BARRUS LIMITED, Oxfordshire (GB)

(72) Inventor: David Phillip Etherington-Smith, Oxfordshire (GB)

(73) Assignee: E.P. Barrus Limited, Oxfordshire (GB)

( * ) Notice: Subject to any disclaimer, the term of this patent is extended or adjusted under 35 U.S.C. 154(b) by 123 days.

(21) Appl. No.: 14/400,955

(22) PCT Filed: Mar. 15, 2013

(86) PCT No.: PCT/GB2013/050659

§ 371 (c)(1),
(2) Date: Nov. 13, 2014

(87) PCT Pub. No.: WO2013/171449

PCT Pub. Date: Nov. 21, 2013

(65) Prior Publication Data

US 2015/0122214 A1 May 7, 2015

(30) Foreign Application Priority Data

May 18, 2012 (GB) ..... 1208738.3

(51) Int. Cl.
*F02M 35/16* (2006.01)
*B63H 20/32* (2006.01)

(52) U.S. Cl.
CPC ..... *F02M 35/165* (2013.01); *B63H 20/32* (2013.01); *F02M 35/168* (2013.01); *Y10T 137/0801* (2015.04)

(58) Field of Classification Search
CPC .. F02M 35/165; F02M 35/167; F02M 35/168; F02M 35/10373; F02M 35/10;
(Continued)

(56) References Cited

U.S. PATENT DOCUMENTS 3,267,920 A * 8/1966 Pagenstecher ..... F01N 13/085 123/1 R
3,653,534 A * 4/1972 Barthel ..... B65D 77/225 251/12

(Continued)

FOREIGN PATENT DOCUMENTS

DE 3736777 C1 12/1988
FR 2929342 A1 10/2009

(Continued)

OTHER PUBLICATIONS

Machine translation of Detailed Description, FR2929342, Janssen et al., Oct. 2, 2009, obtained from http://worldwide.espacenet.com/, pp. 1-8.*

(Continued)

*Primary Examiner* — Grant Moubry
(74) *Attorney, Agent, or Firm* — Renner, Otto, Boisselle & Sklar, LLP

(57) ABSTRACT

A valve (1,1') for a marine propulsion unit comprises a body (2) having an internal passage (3) through the valve body (2). An aperture (5) in the valve body communicates with the internal passage (3). A piston (4,4') is moveably mounted within the internal passage. The valve is configured such that, upon immersion or expected immersion of part (such as an air intake) of an associated propulsion unit in water or tilting of the associated propulsion unit beyond a predefined angle, the piston moves to a first position within the internal passage in which it seals the aperture. If for example the air intake of a marine propulsion unit of a vessel is connected to the aperture (3), the effect of the piston sealing the aperture (5) is to isolate the air intake from the atmosphere. Thus if the vessel sinks or capsizes, the valve closes the air intake of the propulsion unit and so prevents entry of water into the propulsion unit.

8 Claims, 4 Drawing Sheets

(58) Field of Classification Search
CPC ..... F02M 35/10209; F02M 35/10242; F02M 35/10255; B63H 20/32; Y10T 137/0801; F02D 35/00; F02D 41/22; F16K 3/00; F16K 3/0209; F16K 17/00
USPC ..... 123/198 D
See application file for complete search history.

(56) References Cited

U.S. PATENT DOCUMENTS 5,957,072 A 9/1999 Hattori
6,209,559 B1 * 4/2001 Risch ..... F02M 35/10255 123/198 E
6,213,146 B1 * 4/2001 Risch ..... F02M 35/10255 137/388
8,628,364 B2 * 1/2014 Yamazaki ..... F02M 35/168 440/1
2011/0196596 A1 * 8/2011 Schleser ..... F02D 41/0002 701/112
2011/0294372 A1 12/2011 Yamazaki et al.

FOREIGN PATENT DOCUMENTS

GB 2 349 420 A 1/2000
GB 2 354 057 A 3/2001

OTHER PUBLICATIONS

Machine translation of Detailed Description, DE3736777, Bihl, Dec. 15, 1988, obtained from http://worldwide.espacenet.com/, pp. 1-4.*
International Search Report for corresponding International Application No. PCT/GB2013/050659 mailed Jul. 18, 2013.
Form PCT/ISA/237 for corresponding International Application No. PCT/GB2013/050659 mailed Jul. 18, 2013.

* cited by examiner

Top View, Cross section

MARINE PROPULSION UNIT AND A VALVE FOR A MARINE PROPULSION UNIT

The present invention relates to a valve for a marine propulsion unit, in particular to a valve that can close the air intake of an associated marine propulsion unit. It also relates to a marine propulsion unit, for example, such as an outboard motor, having a valve provided to close the air-intake of the marine propulsion unit.

A propulsion unit, such as an internal combustion engine, for a land vehicle is normally not designed in any way for contact with, or immersion in, a body of water. Should such immersion occur as a result of an accident, the engine will stop, become flooded with water, and will need specialist attention before it can be restarted.

It is not unknown for boats fitted with small motors, such as outboard motors, to capsize. This can happen, for example, on a rescue mission, if the boat is swamped by breakers when the boat is working close in shore. Alternatively, when a rescue vessel is approaching another vessel, it is possible for waves to be re-directed by the vessel that requires rescue and these can swamp the rescue vessel. Furthermore, when a rescue vessel is launched into heavy seas it is possible for the boat to be capsized upon launch. When the vessel capsizes the motor will be submerged, and water will flood into the engine.

Even in the case of a vessel provided with a self-righting capability, the engine is generally flooded with water by the time the vessel has righted itself. Water will inevitably enter the engine, even though mercury gravity switches are provided to switch off the engine once a predetermined angle of roll is reached.

There have been attempts to provide water-proof internal combustion engines, for vehicles required to have full on-land/in-water capability such as tanks. A fully waterproofed engine is, however, expensive. Furthermore, maintenance of such engines is complicated, since great care must be taken during maintenance if the waterproofing is to be maintained.

GB 2349420 describes a marine propulsion unit having an aperture that is selectively openable independent of the position of a piston within its cylinder. This allows water to be drained from the propulsion unit, to shorten the time required to restart the propulsion unit after it has been immersed in water.

There have been proposals to provide a moveable flap over an air intake of a marine propulsion unit, such that the flap moves or is moved so as to close the air intake when the vessel sinks or capsizes. However, in practice these are not wholly effective at sealing the air intake against entry of water.

A first aspect of the present invention provides a valve for a marine propulsion unit, the valve comprising: a body; an internal passage through the valve body; an aperture in the valve body, the aperture communicating with the internal passage; and a piston moveable within the internal passage. The valve is configured such that, upon immersion or expected immersion of the air intake, or another aperture, of an associated propulsion unit in water or tilting of the associated propulsion unit beyond a predefined angle, the piston moves to a first position within the internal passage in which it seals the aperture.

Specifying that the piston "moves" to the first position is intended to include a case where the piston is caused to move to the first position by another component as well as a case where the piston moves of its own accord (for example in the case of a naturally buoyant piston as described below).

When the piston seals the aperture in the valve body, any passage connected to the aperture is isolated from the internal passage through the valve body. If for example the air intake and/or another aperture of a marine propulsion unit is connected to the aperture in the valve body, and the internal passage through the valve body communicates with the atmosphere, the effect of the piston sealing the aperture in the valve body is to isolate the air intake and/or other aperture of the marine propulsion unit from the atmosphere. Thus when a vessel sinks or capsizes, a valve of the invention can prevents entry of water into a propulsion unit of the vessel (and in particular can prevent entry of water into the cylinders of the propulsion unit via the air intake).

By "expected immersion" of the air intake is meant, for example, a case in which a vessel is believed to be sinking so that water is expected soon to reach the air intake of a propulsion unit of the vessel. Arranging for the valve to operate based on expected immersion of the air intake provides the advantage that it may be possible to close the air intake before it is immersed in water, which is more effective at preventing entry of water into the propulsion unit.

The piston may be normally biased to a second position in which it does not seal the aperture.

The valve may comprise an actuator for causing the piston to move to the first position upon immersion of the propulsion unit in water or tilting of the propulsion unit beyond the predefined angle.

The valve may comprise an input for receiving a control signal from a sensor upon the sensor detecting immersion of the propulsion unit in water or tilting of the propulsion unit beyond the predefined angle, and the actuator may be configured to cause the piston to move to the first position upon receipt of the control signal.

The actuator may, when operated, directly cause the piston to move to the first position, that is the actuator may operate directly on the piston. In such an embodiment the actuator may for example be a linear actuator.

Alternatively, in a valve of the first aspect, the piston may be naturally biased to the first position, and the valve may comprise a latch for holding the piston in a second position in which it does not seal the aperture. If it is detected that the vessel is about to, or is expected to, capsize, the latch may be operated to release the piston when then moves to the first position under its biasing thereby sealing the aperture.

In an embodiment in which the piston is naturally biased to the first position, and the valve comprises a latch for holding the piston in the second position in which it does not seal the aperture, the valve may further comprise an actuator for causing the piston to move to the first position upon immersion of the propulsion unit in water or tilting of the propulsion unit beyond the predefined angle. In such an embodiment the actuator may, when operated, indirectly cause the piston to move to the first position—for example the actuator may, when operated, release the latch so that the piston is then free to move to the first position as a result of its natural biasing towards the first position.

In embodiments where an actuator is provided, the actuator may be an electro-mechanical actuator, such as a solenoid. The invention is not however limited to an electro-mechanical actuator, and any suitable actuator may be used.

In a further embodiment, the piston of a valve of the first aspect may be buoyant in water.

The valve may comprise a seal provided on an external circumference of the piston for sealing a circumferential gap between the piston and the internal passage against the flow of water.

First and second seals may be provided on an external surface of the piston, the first and second seals being spaced apart from one another along an axis of the cylinder by a distance greater than a dimension of the aperture in a direction parallel to the axis of the cylinder. By spacing the seals in this way, whereby when piston is in first position a first seal seals between the piston and the internal passage on one side of the aperture and the second seal seals between the piston and the internal passage on another side of the aperture.

A second aspect of the invention provides a marine propulsion unit having an air intake, and a valve of the first aspect for closing the air-intake upon immersion or expected immersion of air intake of the propulsion unit in water or tilting of the propulsion unit beyond a predefined angle.

The propulsion unit may further comprise a sensor for controlling operation of the valve.

The sensor may comprise a tilt sensor. Additionally or alternatively it may comprise a sensor for detecting water.

Alternatively, the invention provides an arrangement comprising: a marine propulsion unit having an air intake, a valve of the first aspect for closing the air-intake upon immersion or expected immersion of air intake of the propulsion unit in water or tilting of the propulsion unit beyond a predefined angle; and a sensor for controlling operation of the valve. In this aspect the sensor need not be mounted on the propulsion unit but may be mounted elsewhere in the vessel.

A preferred embodiment of the present invention will now be described by way of illustrative example with reference to the accompanying figures, in which:

FIG. 1(*b*) is a sectional view along the line BB of FIG. 1(*a*);

FIG. 2(*b*) is a sectional view along the line BB of FIG. 2(*a*);

Figure 3B:
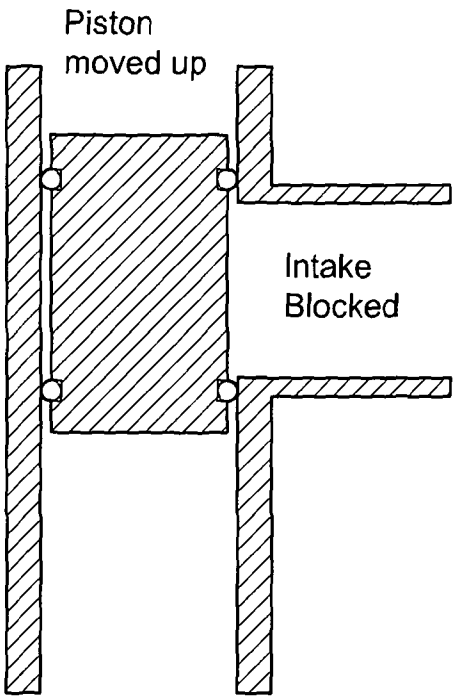
Figure 3A:
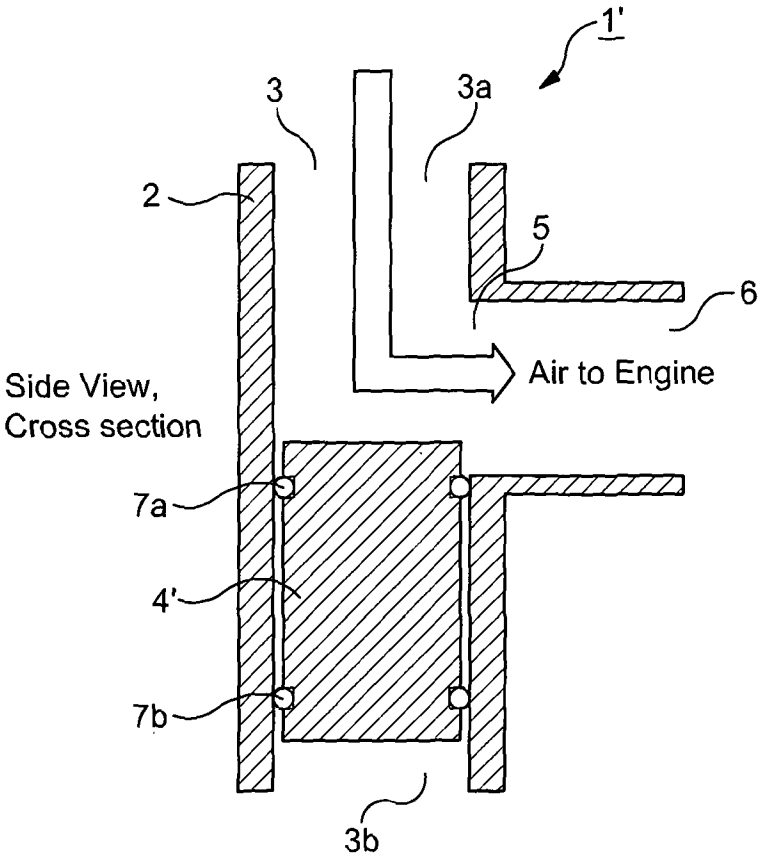
Figure 4A:
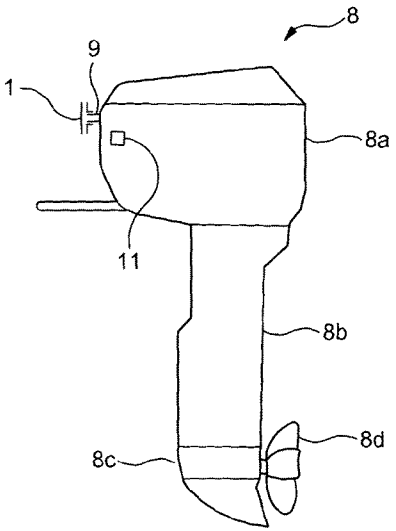
Figure 4B:
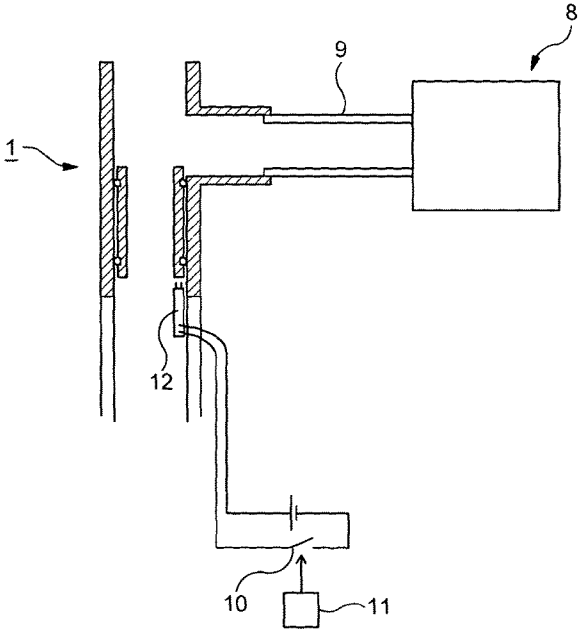

FIGS. 3(*a*) and 3(*b*) are sectional views of a valve according to another embodiment of the invention in its open state and closed state respectively;

FIG. 4(*a*) is a schematic block diagram of a marine propulsion unit incorporating a valve of the present invention;

FIG. 4(*b*) is a partial enlarged view of FIG. 4(*a*).

Figure 5:
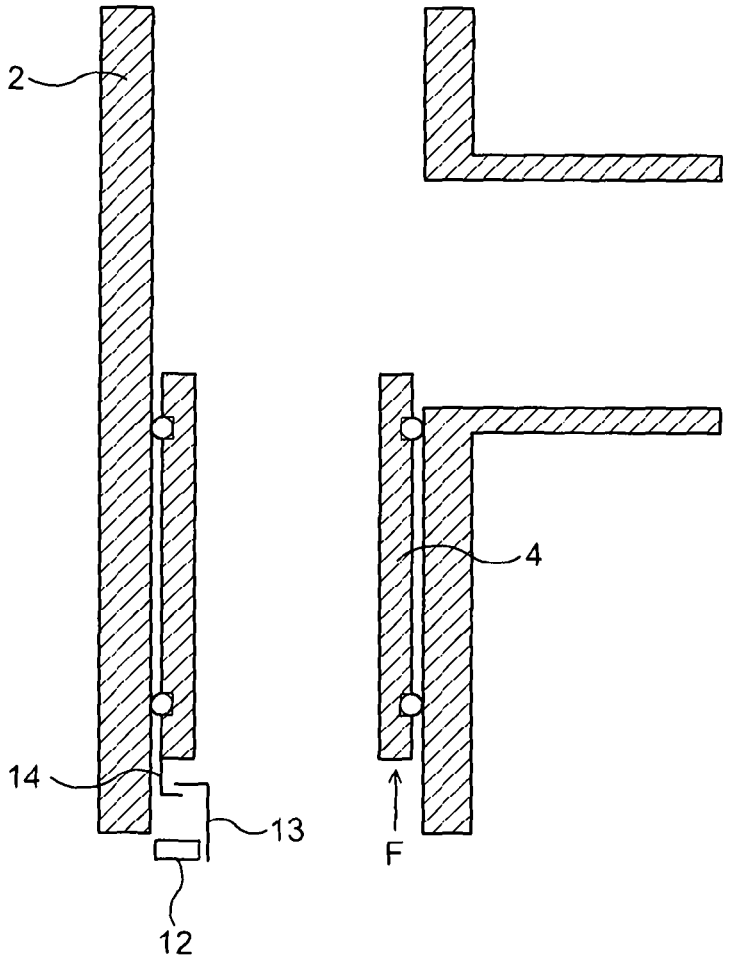

FIG. 5 is a sectional view of a valve according to another embodiment of the invention in its open state.

Figure 1B:
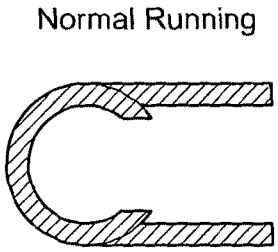
FIG. 1(*a*) is a sectional view of a valve according to one embodiment of the invention in its open state.
Figure 1A:
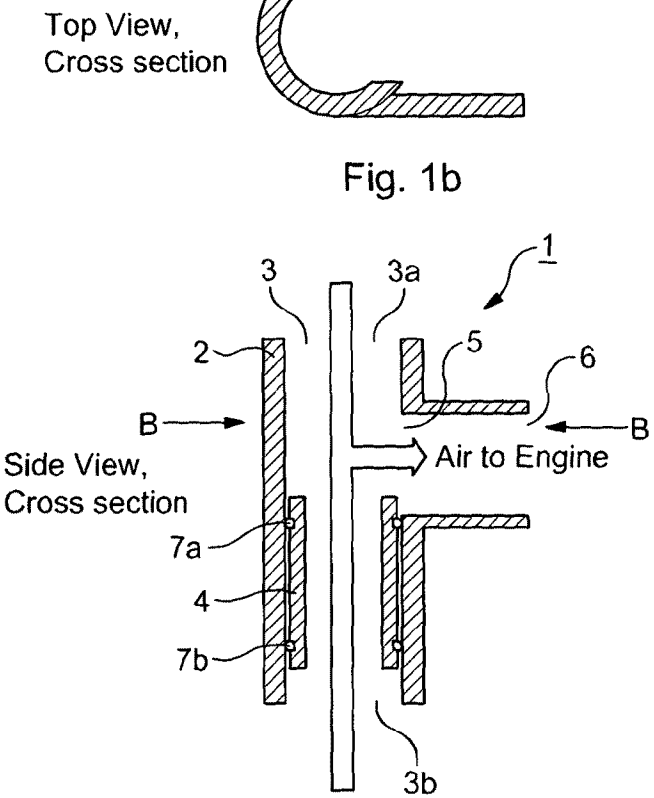

FIG. 1(*a*) is a sectional view through a valve according to one embodiment of the present invention in its open state, and FIG. 1(*b*) is a section through the valve 1 of FIG. 1(*a*) along the line BB shown in FIG. 1(*a*). The valve 1 comprises a valve body 2 having an internal passage 3 running therethrough. A piston 4 is provided in the internal passage 3, and is mounted for movement along the axis of the internal passage 3.

The valve 1 further comprises a side passage 6, which connects with the internal passage 3 by means of an aperture 5 in the valve body. In use the side passage 6 of the valve may be connected to an air intake of a marine propulsion unit so that, when the propulsion unit is running, air enters the internal passage of the valve at one or both ends of the valve, passes into the side passage 6 through the aperture 5, and passes to the air intake of the propulsion unit. The internal passage of the valve may communicate with the atmosphere, via one or both of its upper and lower ports 3*a*, 3*b*.

Figure 2B:
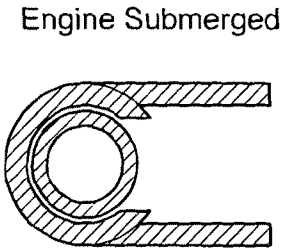
FIG. 2(*a*) is a sectional view of a valve of the invention in its closed state.
Figure 2A:
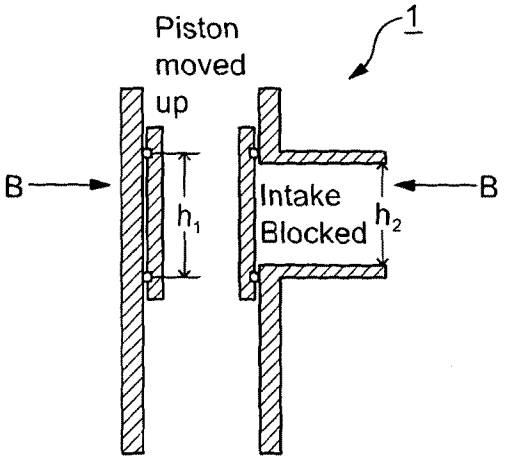

FIG. 1(*a*) and FIG. 1(*b*) show the valve in its "open" position, in which the aperture 5 is open so that the side passage 6 is in fluid communication with the internal passage 3. The piston 4 is moveable within the internal passage, and may move or be moved along the internal passage 3 to put the valve into a "closed" position. FIGS. 2(*a*) and 2(*b*) illustrate the valve 1 in its closed position. As is shown in FIG. 2(*a*), the piston 4 has moved or has been moved within the internal passage 3 of the valve to a position at which it seals the aperture 5 from the internal passage, thereby preventing fluid communication between the internal passage 3 and the side passage 6. Specifying that the valve is "open" or "closed" accordingly refers to whether or not air or other fluids present in the internal passage 3 are able to pass into the side passage 6.

The piston may optionally be biased to the position shown in FIG. 1(*a*) in which it does not seal the aperture, so that the valve is normally "open". Such biasing may be achieved using any suitable bias mean (not shown) such as spring. Alternatively, if the valve is intended to be used in an orientation in which the internal passage is vertical or substantially vertical, the piston may be naturally biased to the position shown in FIG. 1(*a*) under the influence of gravity.

FIGS. 1(*a*), 2(*a*) and 2(*b*) show the piston 4 as having an annular cross-section. This means that, when the valve is in its closed position as shown in FIG. 2(*a*), the internal passage 3 through the valve is still open. The invention is not, however, limited to this. A valve of the present invention may be used on a number of different propulsion units, and the form of the piston may be chosen to suit any particular intended application. For example, the piston may alternatively be solid as shown in FIGS. 3(*a*) and 3(*b*), which show the valve 1' of this alternative embodiment in its open and closed states respectively. In this alternative embodiment air cannot pass along the internal passage 3 since the piston 4' is solid, and operation of the valve determines whether the upper port 3*a* of the valve communicates with the side passage 6 or not. In this embodiment, the lower port 3*b* of the valve is not in fluid communication with the side passage, regardless of whether the valve is open or closed.

In a preferred embodiment of the invention, one or more sealing members are provided to ensure that the seal between the exterior of the piston 4,4' and the interior of the internal passage 3 is as air tight as possible. FIGS. 1(*a*), 2(*a*), 3(*a*) and 3(*b*) show a particularly preferred embodiment, in which two seals 7*a*, 7*b* are provided on the exterior of the piston, spaced from one another along the axis of the piston 4. The separation h1 between the two seals is greater than the dimension h2 of the aperture 5, measured parallel to the axis of the internal passage 3 of the valve, so that, when the valve is in its closed stage, one seal 7*a* seals between the external surface of the piston and the internal surface of the passage 3 on one side of the aperture 5, and the other seal 7*b* seals between the exterior of the piston and the internal surface of the valve on the upper side of the aperture 5. This provides an effective seal between the side passage 6 and both the upper and lower ports 3*a*, 3*b* of the valve Providing the seal(s) 7*a*, 7*b* between the exterior surface of the piston 4 and the internal surface of the valve body 2 has the advantage that the pressure required to make an air tight seal is naturally present, as the or each seal is compressed between the exterior surface of the piston 4 and the interior surface of the valve body 2. In contrast, in prior art marine propulsion units in which the air intake is closed by closing a flap over the intake, it is necessary to apply a continual force to the flap in order to maintain a seal and thus close the intake—so, if there should be a power failure for example, the flap may cease to seal properly and water may be able to enter the air intake of the propulsion units. The present invention thus allows a more reliable seal, and a much tighter seal, to be achieved.

Each seal may be formed by an O-ring, for example a sliding O-ring. Moving the piston in order to close or open the aperture 5 requires only that the friction of sliding the O-ring along the internal surface of the valve body 2 is to be overcome, and this means that actuation of a valve of the present invention is straightforward. Each O-ring is preferably mounted in an annular groove in the exterior surface of the cylinder as shown in FIGS. 1(*a*), 2(*a*), 3(*a*) and 3(*b*).

The dimensions of the valve may be chosen to suit an intended application—in particular the cross-sectional areas of the internal passage and of the side passage 6 may be chosen to ensure that, when the valve is open, the valve can provide a desired flow rate of air to the air intake of a marine propulsion unit connected to the side passage of the valve. For example, values for the internal diameter of the internal passage, and the external diameter of the piston, are typically in the range 20 mm to 100 mm. The internal diameter of the side passage may, as shown in FIG. 1(*b*), be comparable to the internal diameter of the internal passage, although the internal diameter of the side passage may alternatively be less than the internal diameter of the internal passage.

The valve body and the piston may be made of any material that is sufficiently durable for the intended use of the valve. The valve body and the piston may for example be made from a metal, such as aluminium or brass. Alternatively the valve body and/or the piston may be made from a suitable plastics material—in particular if it desired for the piston to be naturally buoyant in water the piston may be made of a plastics material.

FIG. 4(*a*) is a schematic block diagram of a marine propulsion unit fitted with a valve of the present invention. The marine propulsion unit 8 shown in FIG. 4(*a*) is an outboard motor having a powerhead 8*a* containing an engine (not shown), a midsection 8*b*, a lower unit 8*c*, and a propeller 8*d* mounted on the lower unit and driven via a gearbox (not shown) in the lower unit. However, the invention may be applied with a wide variety of propulsion units, and is not limited to use with a propulsion unit 8 that is an outboard motor.

The marine propulsion unit has an air intake, shown schematically as 9. A valve 1 of the present invention is provided on the air intake, with the side passage 6 of the valve 1 being connected to the air intake 9. The marine propulsion unit is also provided with one or more sensors 11 (only one shown in FIG. 4(*a*)) for controlling operation of the valve 1 as described in more detail below. (Although shown in FIG. 4(*b*) as mounted on the exterior of the powerhead 8*a*, the sensor(s) would typically be disposed within the powerhead.)

FIG. 4(*b*) is a partial enlarged view of FIG. 4(*a*). In the embodiment of FIG. 4(*b*) the piston 4 is caused to move along the internal passage of the valve body by means of an actuator 12 provided in the valve 1. In this example the actuator 12 directly causes the piston to move along the internal passage of the valve. The actuator may for example be a solenoid actuator. The actuator is controlled by means of a switch 10—when switch 10 is open as shown in FIG. 4(*b*) the valve is in an open position, and closing the switch 10 energises the solenoid actuator 12, causing the armature of the actuator to move relative to the coil of the actuator such that movement of the armature causes the piston 4 to move through the internal passage 3 of the valve, thus putting the valve in its closed position as shown in FIG. 2(*b*) or 3(*b*). (It should be noted that stating that an actuator or actuating device "directly" causes the piston to move does not necessarily require direct contact between the actuator and the piston and there may optionally be some mechanism that transmits movement of the actuator to the piston—for example in the case of a solenoid actuator, the armature of the solenoid may make direct contact with the piston or the armature of the solenoid may act on a drive mechanism that transmits movement of the armature of the solenoid to the piston.)

The switch 10 can be controlled by an input derived from the one or more sensors 11. For example, the sensor 11 may detect the presence of water. If a boat in/on which the propulsion unit 8 and valve 1 are mounted should start to sink, the water level will rise relative to the propulsion unit, and will eventually reach the level of sensor 11. When the sensor detects that it is in contact with water the output from sensor 11 changes thereby closing the switch 10, and causing the piston 4 to move to put the valve 1 in its closed state—thereby closing the air intake of the propulsion unit. If the boat sinks, water will therefore not be able to enter the propulsion unit by its air intake 9, as this is closed by the valve 1. When the boat is recovered the propulsion unit does not require to be drained of water and can be re-started almost immediately.

If the sensor 11 is a sensor that detects when it is in contact with water, the sensor is preferably mounted at a level below the level of the air intake 9. This allows time for the valve to close before the water level reaches the valve Alternatively, the sensor 11 may be a tilt sensor, that detects the angle of tilt of a boat in which the propulsion unit is mounted. If the sensor 11 detects that the tilt of the boat has reached a value at which the boat is likely to capsize, the sensor 11 may again send an output that is effective to close the switch 10 and thereby put the valve 1 into its closed state. If the boat should capsize, water is again prevented from entering the air intake of the marine propulsion unit. When the vessel is righted, the propulsion unit does not require to be drained of water and can be re-started almost immediately.

As a further alternative, switch 10 may be controlled by the output from both a water level sensor and a tilt sensor, so that the air intake of the propulsion unit 8 is closed if the vessel sinks or if the vessel capsizes.

It should be understood that the present invention is not limited to the embodiments described above. For example, the valve is not limited to actuation by a solenoid actuator as shown in FIG. 4(*b*). In an alternative embodiment, the piston 4 of the valve may be made such that the piston is naturally buoyant, for example by making the piston 4 of a buoyant plastics material. The valve 1 may be oriented such that the internal passage 3 through the valve is substantially vertical, and is open at its upper and lower ends. If the vessel should start to sink, the water level will rise and, when the water level reaches the piston 4, the piston will float owing to its natural buoyancy. As the water level increases further, the piston will move along the internal passage until it closes the aperture 5 as shown in FIG. 2(*a*)—thereby preventing water from entering the air intake of the engine. In this embodiment, it is preferable for a means for preventing further travel of the piston 4 to be provided, so that the piston continues to seal the aperture even if the water level rises further—this may be arranged by, for example, providing a region of reduced internal diameter in the internal passage 3 so as to prevent further movement of the piston 4 beyond the position in which it seals the aperture 5.

Moreover, where the invention is embodied using an actuator to move the piston 4 along the internal passage of the valve body the invention is not limited to an electro-mechanical solenoid actuator as in the above embodiment. Any suitable actuator may be used. By referring to an "actuator" that moves the piston along the internal passage of the valve body is meant a component that, under control of a suitable control system, moves the piston a desired distance along the internal passage of the valve body. Any suitable actuator may be used, including (but without limitation) an electro-magnetic actuator, a mechanical actuator, a linear motor, a hydraulic actuator such as a hydraulic cylinder, a pneumatic actuator such as a pneumatic cylinder, a telescopic actuator, or a piezoelectric actuator.

In a further example the actuator 12 may be a linear actuator, for example an electro-mechanical linear actuator. A "linear actuator" is an actuator that creates motion in a straight line. Many linear actuators are reversible, and so can be used both to move the piston 4 so as to close the valve and to move the piston 4 so as to open the valve.

FIG. 4(*b*) shows the actuator pushing on the piston 4 to move it to the position in which it closes the aperture 5. The invention is not limited to this and the actuator may alternatively be arranged to pull on the piston 4 to move it to the position in which it closes the aperture 5.

As a further alternative, the piston may be biased, for example spring-loaded, towards the position in which it closes the aperture 5, but can be held in a position in which the aperture 5 is open by means of a catch or latch (for example a pin that engages with the piston so as to hold the piston in a position in which the aperture 5 is open). The actuator 12 may then be arranged to control the catch or latch, so that when the sensor detects water or excessive tilt the actuator cause the catch or latch to release the piston which then moves to the position in which it closes the aperture 5 as a result of the biasing of the piston. A valve according to such a further embodiment is shown schematically in FIG. 5 (FIG. 5 is shown at a larger scale than other figures, but this is for clarity only). The valve of FIG. 5 is generally similar to that of FIG. 1(*a*) and description of components that are the same as for the valve of FIG. 1(*a*) will not be repeated. The piston 4 of the valve of FIG. 5 is biased towards a position in which it closes the valve, by bias means (not shown) that apply a biasing force F to the piston 4. However, in normal operation the valve is maintained in the open state by a latch, shown schematically as 13, that engages with the piston, for example with a catch 14 provided on the piston, and holds the piston at a position in which it does not close the valve. In this embodiment the actuator 12 does not operate directly on the piston 4, but instead acts on the latch 13 so as to cause the latch 13 to disengage from the piston so that the piston can move to a position in which it closes the valve as a result of the biasing force F. As in the embodiment of FIG. 4(*b*), the actuator 12 of FIG. 5 may be controlled by a switch circuit that has an input derived from one or more sensors such a one or more sensors that detect the presence of water and/or one or more tilt sensors.

As a yet further alternative the valve may be arranged such that the piston can be moved manually to a position in which it closes the aperture 5. If the propulsion unit is to be stored for a period of time, this allows the air intake to be closed at the start of the storage period and thereby prevent accidental entry of water into the propulsion unit through its air intake during storage.

When boat having a propulsion unit fitted with a valve of the invention sinks or capsizes, the valve will close to prevent water entering the air intake of the propulsion unit. When the boat is recovered/righted the propulsion unit can be started without difficulty, since little or no water will have entered the engine. It is of course necessary to reset the valve and so re-open the air-intake of the propulsion unit in order to re-start the propulsion unit, and this may be done in any suitable way. For example, where a solenoid actuator is used to move the piston and close the valve, the valve may be opened by manually moving the piston, or the piston may be normally biased to its open position. Where a linear actuator is used to close the valve, the linear actuator may also be used to move the piston and open the valve, for example by providing a control circuit that can be used to drive the linear actuator so that it moves the piston to the position in which the aperture 5 is open. Where the piston is biased towards the position in which it closes the aperture 5 and is normally held in a position in which the aperture 5 is open by means of a catch or latch, the valve may be opened by manually moving the piston and re-engaging the catch or latch.

In general, a marine propulsion unit will have other apertures in addition to the air intake. For example an internal combustion engine generally has one or more crankcase vents that allow any unburnt fuel or combustion product that leak past the pistons into the crankcase of the engine to be vented (for example into the engine's inlet manifold). An internal combustion engine may also have one or more fuel injection vents. If a marine propulsion unit submerges, it is desirable that other apertures, such as the crankcase and fuel injection vents, are closed as well as the air intake, to prevent any water from leaking into the marine propulsion unit. A valve of the present invention may be arranged to close one or more other apertures in a marine propulsion unit, in addition to closing the air intake, when the boat containing the marine propulsion unit is about to capsize or sink.

This may for example be done by arranging for other apertures such as, for example, the crankcase vents to communicate with the side passage 6 of the valve. Thus, when the valve closes, the crankcase vents are also isolated from the upper and lower ports of the valve and water cannot enter the crankcase vents.

The invention claimed is:

1. An arrangement comprising:

a marine propulsion unit having an air intake, and a valve for closing the air intake upon tilting of the propulsion unit beyond a predefined angle, the valve comprising:

a body;

an internal passage through the valve body, the internal passage communicating with the atmosphere;

an aperture in the valve body, the aperture communicating with the internal passage; and a piston moveable within the internal passage;

wherein the valve is configured such that, upon tilting of the propulsion unit beyond the predefined angle, the piston moves to a first position within the internal passage in which it seals the aperture to thereby isolate the air intake from the internal passage through the valve body;

and wherein the valve further comprises an actuator for causing the piston to move to the first position upon tilting of the propulsion unit beyond the predefined angle; and a tilt sensor for controlling operation of the valve of the marine propulsion unit.

2. The arrangement as claimed in claim 1 wherein the piston is naturally biased to a second position in which it does not seal the aperture.

3. The arrangement as claimed in claim 1, wherein the valve further comprises an input for receiving a control signal from the sensor upon the sensor detecting tilting of the propulsion unit beyond the predefined angle, the actuator being configured to cause the piston to move to the first position upon receipt of the control signal.

4. The arrangement as claimed in claim 1 wherein the actuator is a linear actuator.

5. The arrangement as claimed in claim 1 wherein the piston is naturally biased to the first position, and wherein the valve comprises a latch for holding the piston in a second position in which the piston does not seal the aperture.

6. The arrangement as claimed in claim 1 wherein the piston is buoyant in water.

7. The arrangement as claimed in claim 1, wherein the valve comprises a seal provided on an external circumference of the piston for sealing a circumferential gap between the piston and the internal passage against a flow of water.

8. The arrangement as claimed in claim 7 wherein the valve comprises first and second seals provided on the external circumference of the piston, the first and second seals being spaced apart from one another along an axis of the piston by a distance greater than a dimension of the aperture in a direction parallel to the axis of the piston.

* * * * *